United States Patent [19]

Spies

[11] 4,065,930

[45] Jan. 3, 1978

[54] MINE ROOF SUPPORT

[75] Inventor: Klaus Spies, Dortmund-Persebeck, Germany

[73] Assignee: Bochumer Eisenhutte Heintzmann GmbH & Co., Bochum, Germany

[21] Appl. No.: 783,469

[22] Filed: Mar. 31, 1977

[30] Foreign Application Priority Data

May 19, 1976 Germany ..... 2622208

[51] Int. Cl.[2] ..... E21D 15/44

[52] U.S. Cl. ..... 61/45 D

[58] Field of Search ..... 61/45 D; 299/31-33; 248/357; 91/170 MP

[56] References Cited

U.S. PATENT DOCUMENTS 3,928,981 12/1975 Parker et al. ..... 61/45 D

FOREIGN PATENT DOCUMENTS 1,583,115 6/1973 Germany ..... 61/45 D 426,046 10/1974 U.S.S.R. ..... 61/45 D

*Primary Examiner*—Dennis L. Taylor

*Attorney, Agent, or Firm*—Michael J. Striker

[57] ABSTRACT

A mine roof support for an underground mine gallery includes a sole plate resting on the floor of the mine gallery, a roof shield pressed against the roof of the mine gallery by a plurality of hydraulically operated props, and means for maintaining the position of the props relative to the sole plate and the roof shield.

11 Claims, 5 Drawing Figures

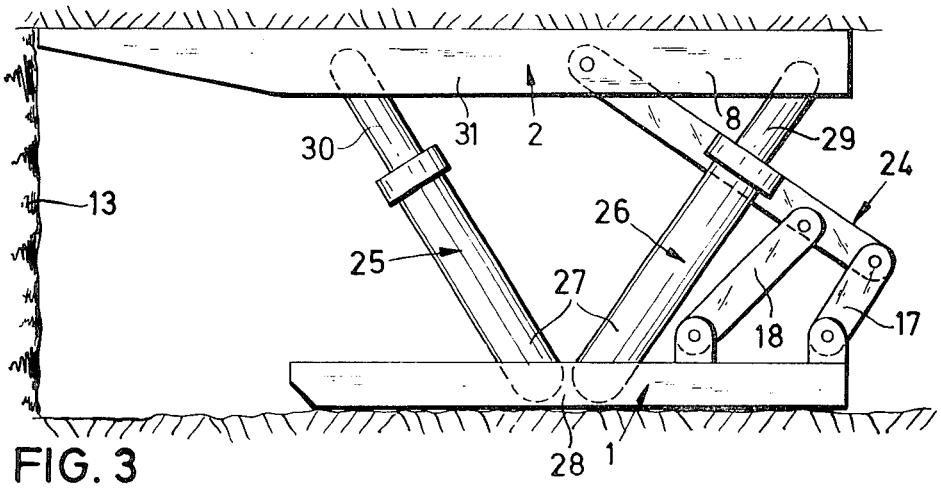
FIG. 3
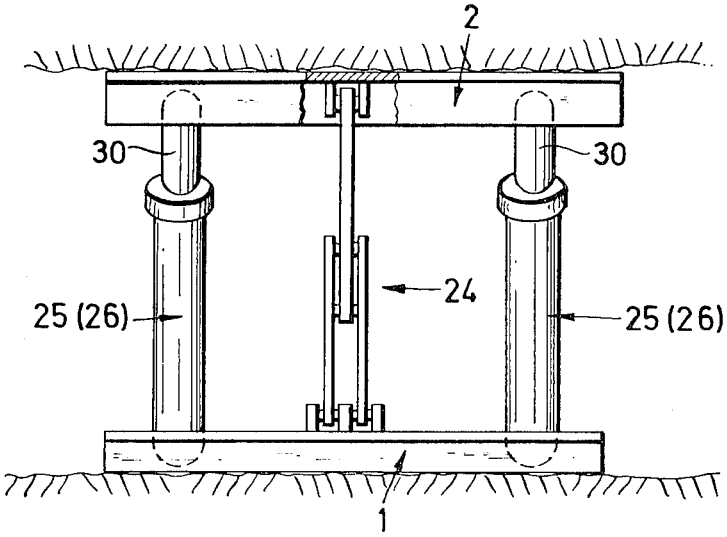
FIG. 4
FIG. 5
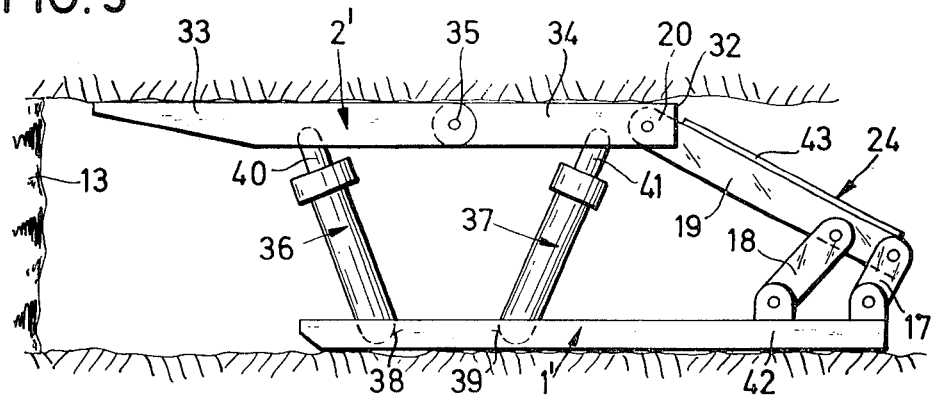

MINE ROOF SUPPORT

BACKGROUND OF THE INVENTION

The present invention relates to a mine roof suppport which has a preferably one part sole plate and a roof shield which may be pivotally subdivided, in which the sole plate and the roof shield are respectively pressed by a plurality of props against the floor and the roof of the mine gallery, and in which means are provided to maintain the position of the props relative to the sole plate and the roof shield.

While many attempts have already been made in the art to satisfy the requirement of maintaining the position of the props relative to the sole plate and the roof shield, none of the known constructions properly counteract the forces tending to shift the roof shield and the sole plate in horizontal direction. These forces resulting from the pressure of the surrounding rock tend to move the roof shield relative to the sole plate in the direction toward, respectively away from the mine face. The thereby resulting stresses in the props and at the pivotal connections thereof to the sole plate, respectively to the roof shield, are high and lead to such damage of the props or the connections thereof, which makes an exchange of the props necessary. This evidently leads to interruption of the operation. Various attempts have already been made to coordinate stabilizing elements with the props to maintain the latter substantially normal to the longitudinal direction of the sole plate and the roof shield, even if relatively great forces try to shift the sole plate and roof shield in longitudinal direction with respect to each other. Such known stabilizing elements are for instance spring packages or direction cylinders which, as a rule, are connected to the sole plate and act on the lower region of the props. Even though the known stabilizing elements are of relatively complicated constructions, they are only to a limited degree able to counteract the shifting forces between the sole plate and the roof shield. The reason for this failure is the usually large lever arm between the sole plate and the roof shield, which prevents with the known stabilizing elements to establish an effective counterforce against the above-mentioned shifting forces.

SUMMARY OF THE INVENTION

It is an object of the present invention to provide a mine roof support of the above-mentioned kind which overcomes the above-mentioned shortcomings of the mine roof supports known in the art.

It is a further object of the present invention to provide a mine roof support which will properly counteract horizontal shifting forces resulting from the surrounding rock between the sole plate and the roof shield.

It is an additional object of the present invention to provide a mine roof support of the aforementioned kind which is composed of relatively few and simple parts so that it can be produced at reasonable cost and will properly stand up during extended use.

With these and other objects in view, which will become apparent as the description proceeds, the mine roof support according to the invention for an underground mine gallery mainly comprises sole plate means adapted to rest on the floor of the mine gallery and having a front end directed towards the mine face and an opposite end, roof shield means upwardly spaced from the sole plate means and having a front end directed towards the mine face and an opposite rear end, at least one expansible and collapsible prop pivotally connected at opposite ends to said roof shield means and said sole plate means and extending from the latter forwardly and upwardly inclined towards said roof shield means, at least one additional expansible and collapsible prop pivotally connected at opposite ends thereof to said roof shield means and said sole plate means and extending from the latter upwardly and rearwardly inclined towards said roof shield means, and means for maintaining the position of the props relative to said sole plate means and said roof shield means and comprising a laminescate-guide arrangement including two shorter links and one longer link connecting said shorter links and projecting with an end portion beyond the latter, in which the shorter links are pivotally attached at their ends thereof spaced from the longer link to one of the first two mentioned means and said end portion of said longer link is pivotally attached to the other of the two first mentioned means.

An essential feature of the invention is that at least one of the props between the sole plate means and the roof shield means is inclined in direction towards the mine face and at least one other of the props is inclined in the opposite direction. Of course, it is also possible to arrange additional props between the roof shield means and the sole plate means which extend substantially normal to the same. However, the arrangement of a plurality of props in the aforementioned inclined manner will already assure an effective counter-action of the horizontally acting shifting forces in both directions, without essentially reducing proper support of the mine roof. This counteraction of the shifting forces produced by the inclined props is further supported by the laminescate-guide arrangement which, in a known manner, comprises two shorter and one longer link of which the latter is pivotally attached to the shorter links which are spaced in the longitudinal direction of the mine roof support from each other. Such a laminescate guide arrangement will, when properly connected between the sole plate means and the roof shield means permit, on the one hand, change of the vertical distance between the roof shield means and the sole plate means over a large region and, on the other hand, effectively resist shifting of the roof shield means relative to the sole plate means in a direction normal to the mine face. The combined action of the inclined props and of the laminescate guide arrangement permits therefore, with a simple construction, to properly counteract the shifting forces and therewith to reduce the stresses imparted to the props and the bearing means therefor.

The laminescate guide arrangement may be connected to the remainder of the mine roof support in various different ways. According to a preferred construction, the two shorter links are connected to the sole plate means and the free end of the longer link is pivotally connected to the roof shield means. In this way a toggle joint-like arrangement is obtained in which the links are inclined towards the mine filling. An arrangement is, however, also possible in which the two shorter links are pivotally connected to the roof shield means and the free end of the longer link is pivotally connected to the sole plate means. The links are in both cases preferably formed by bending resistant profiles having a sufficient resistance against buckling in the longitudinal direction thereof.

The inclination of the props and the arrangement relative to each other, respectively to the sole plate means and the roof shield means can, according to the invention, also be carried out in various different ways. In one advantageous arrangement the props are attached to the sole plate means and the roof shield means so that they cross each other in the longitudinal direction of said mine roof support. It is thus possible to provide on each longitudinal side of the mine roof support two props in a crosswise arrangement between the sole plate means and the roof shield means. To which extent the props should be inclined and where its link points to the sole plate means, respectively to the roof shield means, are to be arranged, will depend on the conditions of the region of mine gallery at which the mine roof support is used.

In another embodiment according to the present invention, which, however is as advantageous as the abovedescribed one, the props are arranged in V-shape between the sole plate means and the roof shield means and the lower pivotal connections of the props to the sole plate means are arranged closely adjacent each other in the longitudinal direction of the sole plate means. In both of the above-described modifications it is advantageous that the shorter links are connected to the rear region of the sole plate means and the free end of the longer link is pivotally connected in the region between the pivotal connections of the props to the roof shield means. These arrangements will permit, even at relatively small height of the mine gallery, easy access to all portions of the mine roof support, as well as a sufficiently large clear cross-section for ventilation of the mine gallery.

If the mine roof support is used in an underground mine gallery of a specially low height, a construction according to the invention has proven advantageous in which the props are arranged in V-form between the sole plate means and the roof shield means, in which the lower ends of the props are connected pivotally to portions of the sole plate means which are spaced in longitudinal direction of the latter, in which the sole plate means has a rear end portion projecting in a direction away from the mine face beyond the rear end of the roof shield means, and in which the lower ends of the shorter links are pivotally attached to said projecting rear end portion of the sole plate means and the free end of the longer link is pivotally attached to the rear end of the roof shield means. While this construction requires a somewhat longer mine roof support, it provides on the other hand, sufficient free space between the props arranged in V form, respectively, the laminescateguide arrangement, as well as the necessary free cross-section for proper ventilation.

In the arrangement in which the shorter links are connected to the rear end portion of the sole plate means and the free end of the longer link is connected to the roof shield, it can further be of advantage if the longer link is provided along its upper edge with a plate extending transverse to opposite sides of the upper edge to thus form a shield against loose rocks of the mine filling.

The connection of the laminescate guide arrangement to the remainder of the mine roof support can also be carried out in different ways. Thus, it is for instance possible to arrange two laminescate guide arrangements between the sole plate means and the roof shield means, in which the two arrangements are symmetrically arranged with respect to a vertical longitudinal plane of symmetry of the mine roof support. However, it is preferred to provide a single laminescate guide arrangement located in the vertical plane of symmetry of the mine roof support.

The novel features which are considered as characteristic for the invention are set forth in particular in the appended claims. The invention itself, however, both as as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a schematic side view of a further embodiment of a mine roof support according to the invention, in which the props are arranged in V form and in which the laminescate guide arrangement is connected to the rear end portion of the mine roof support;

FIG. 4 is a partially sectioned front view of the embodiment shown in FIG. 3, as viewed from the mine face; and FIG. 5 is a schematic side view of a third embodiment of a mine roof support according to the invention.

DESCRIPTION OF THE PREFERRED EMBODIMENTS

Figure 1:
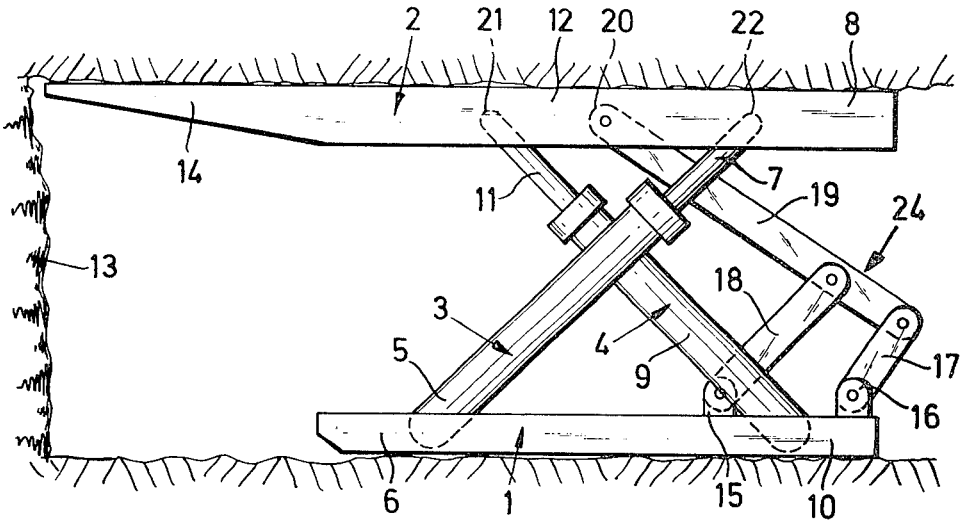
FIG. 1 is a schematic side view of one embodiment of a mine roof support according to the invention, in which the mine roof support is provided with props crossing each other and in which the laminescate guide arrangement is provided in the rear end region of the mine roof support.
Figure 2:
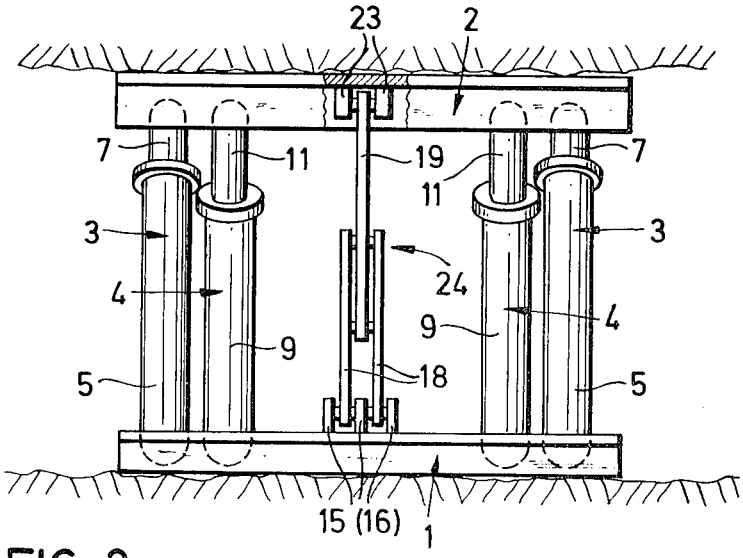
FIG. 2 is a partially sectioned front view of the mine roof support illustrated in FIG. 1 as seen from the mine face.

Referring now to the drawing, and more specifically to FIGS. 1 and 2 of the same, it will be seen that the mine roof support according to the invention may comprise a one-piece sole plate means 1 adapted to rest on the floor of a mine gallery and a one-piece roof shield means 2. Two pairs of hydraulically operated, collapsible and expansible props 3 and 4 are pivotally connected at opposite ends to said sole plate means 1 and the roof shield means 2 to press the latter against the roof of the mine gallery. The pairs of props are arranged in such a manner that they cross each other intermediate the opposite ends thereof. The arrangement is made in such a manner that the outer props 3 (FIG. 2) are pivotally connected with their cylinders 5 to the region of the front portion of the sole plate means 1, while the piston rods 7 thereof are connected to the rear end portion 8 and roof shield means 2, whereas the two inner props 4 are pivotally connected at the lower ends of their cylinders 9 to the rear end region 10 of the sole plate means 1 and their piston rods 11 are pivotally connected at the upper ends thereof substantially in the middle region 12 of the roof shield means 2, which is provided with a portion 14 projecting beyond the front end of the sole plate means 1 toward the mine face 13.

Two bearing blocks 15 and 16 are mounted spaced from each other in the longitudinal direction of the sole plate means 1 on the rear end portion 10 of the latter, in a vertical plane of symmetry of the mine roof support. Two pairs of guide links or guide straps 17, 18 are pivotally connected at the lower ends respectively to the bearing blocks 15 and 16, of which the pair 17 arranged at the rear end of the sole plate means 1 is shorter than the other pair 18. The guide links 17 and 18 extend from the lower ends thereof upwardly and rearwardly inclined. The upper end portions thereof are arranged closely adjacent to opposite sides of the longer link 19 and are pivotally connected to the latter. The free end portion of the longer link 19 is pivotally connected to a bearing block 23 fixed to the roof shield means 2. The guide arrangement 17, 18 and 19 forms therefore a laminescate guide arrangement 24 between the sole plate means 1 and the roof shield means 2. This guide arrangement assures a positive guiding of the roof shield means 2 relative to the sole plate means 1 in vertical direction and prevents a horizontal relative movement of roof shield means and sole plate means in direction toward or away from the mine face 13.

In the modification shown in FIGS. 3 and 4, the laminescate guide arrangement is constructed and connected to the sole plate means 1 and the roof shield means 2 in the same manner as described above in connection with FIGS. 1 and 2. The pairs of props 25, 26 in the modification shown in FIGS. 3 and 4 are however inclined with respect to each other to form a V-shaped arrangement, in which the props at each longitudinal side of the mine roof support are respectively located in planes equally spaced to opposite sides of a vertical plane of symmetry of the mine roof support. The lower ends of the cylinders 27 of the props are arranged thereby one after the other, directly adjacent each other in the middle region 28 of the sole plate means 1, whereas the upper ends of the piston rods 29 of the rear props 26 are connected to the rear end portion 8 of the roof shield means 2, whereas the upper ends of the piston rods 30 of the props 25 are pivotally connected to the region of the front portion of the roof shield means 2.

In the embodiment shown in FIG. 5, which as viewed from the mine face 13 corresponds to the showing of FIG. 4, the sole plate means 1' has a rear end portion 42 which projects beyond the rear end 32 of the roof shield means 2'. The roof shield means 2' comprises in this embodiment two members or portions 33 ad 34, which are pivotally connected to each other at adjacent ends by a pivot pin 35, so as to be tiltable with respect to each other in vertical direction. The props 36 and 37 at each longitudinal side of the mine roof support are again arranged in V form with respect to each other, whereby the lower ends 38 and 39 of the props are arranged from each other in the longitudinal direction of the sole plate means 1'. The piston rods 40 of the props 36 engage thereby the front member 33 of the roof shield means 2' in the middle region thereof and the piston rods 41 of the rear props 37 engage the rear member 34 of the roof shield means 2' substantially in a middle region thereof.

In the embodiment shown in FIG. 5 the laminescate guide arrangement 24 is likewise arranged in a longitudinal plane of symmetry of the mine roof support, but in its entirety rearwardly of the prop 37. The longer link 19 is thereby connected to the rear end 32 of the rear member 34 of the roof shield means, whereas the two shorter links 17 and 18 are pivotally mounted at the lower ends thereof on the rear end portion 42 of the sole plate means 1'. The longer link 19 is in the form of a flat bar having an upper edge and a plate 43 extending transverse to the flat bar to opposite sides of the upper edge thereof is fixedly connected thereto to form a rear shield protecting the mine roof support against loose rocks of the mine filling.

The conduits for feeding pressure fluid into and out of the props constructed in a conventional manner, do not form part of the present invention and are therefore not shown in the drawings.

It will be understood that each of the elements described above, or two or more together, may also find a useful application in other types of mine roof supports differing from the types described above.

While the invention has been illustrated and described as embodied in a mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mine roof support for an underground mine gallery comprising sole plate means adapted to rest on the floor of a mine gallery and having a front end directed toward the mine face and an opposite end; roof sheild means upwardly spaced from said sole plate means and having a front end directed towards the mine face and an opposite rear end; at least one extensible and collapsible prop pivotally connected at opposite ends to said roof shield means and said sole plate means and extending from the latter forwardly and upwardly inclined toward said roof shield means; at least one additional extensible and collapsible prop pivotally connected at opposite ends to said roof shield means and said sole plate means and extending from the latter upwardly and rearwardly inclined towards said roof shield means; and means for maintaining the position of said props relative to said sole plate means and said roof shield means and comprising a laminescate guide arrangement including two shorter links and one longer link connecting said shorter links and projecting with an end portion beyond the latter, said shorter links being pivotally attached at the ends thereof spaced from said longer link to one of said two first-mentioned means and said end portion of said longer link being pivotally attached to the other of said two first-mentioned means.

2. A mine roof support as defined in claim 1, wherein said ends of said shorter links are pivotally attached to said sole plate means and the free end of said end portion of said longer link is pivotally attached to said roof shield means.

3. A mine roof support as defined in claim 1, wherein said props are attached to said sole plate means and said roof shield means so that they cross each other in the longitudinal direction of said mine roof support.

4. A mine roof support as defined in claim 1, wherein said props are pivotally connected to said sole plate means and said roof shield means with the lower pivotally connected ends of said props arranged closely adjacent each other in the longitudinal direction of said sole plate means and the upper pivotally connected ends of said props spaced in the longitudinal direction of said roof shield means are considerably further apart than the lower ends so as to form a V-shaped arrangement.

5. A mine roof support as defined in claim 2, wherein said ends of said shorter links are pivotally attached to the region of said opposite end of said sole plate means and wherein said free end of said longer link is pivotally attached to said roof shield means between the attaching points of said props to said roof shield means.

6. A mine roof support as defined in claim 1, wherein said sole plate means has a rear end portion projecting in a direction away from the mine face beyond said rear end of said roof shield means, wherein the ends of said props pivotally attached to said roof shield means are spaced from each other in the longitudinal direction of said mine roof support a greater distance than the ends of said props which are pivotally attached to said sole plate means, and wherein said lower ends of said shorter links are pivotally attached to said projecting rear end portion of said sole plate means and said free end of said longer link is pivotally attached to said rear end of said roof shield means.

7. A mine roof support as defined in claim 1, wherein said longer link is in form of a flat bar having an upper edge and including a plate extending transverse to said flat bar to opposite sides of said upper edge fixedly connected thereto to form a rear shield for said mine roof support.

8. A mine roof support as defined in claim 6, wherein said longer link is in the form of a flat bar having an upper edge and including a plate extending transverse to the flat bar to opposite sides of said upper edge fixedly connected thereto to form a rear shield for said mine roof support.

9. A mine roof support as defined in claim 6, wherein said roof shield means comprises two members aligned in longitudinal direction of said mine roof support with each other and pivotally connected to each other at adjacent ends, and wherein one of said props is pivotally connected at one end to one of said members and the other of said props is pivotally connected at one end to the other of said members.

10. A mine roof support as defined in claim 1, wherein said links of said laminescate guide arrangement are located in a vertical longitudinal plane of symmetry of said mine roof support.

11. A mine roof support as defined in claim 10, wherein said mine roof support comprises two props arranged mirror-symmetrically to said plane of symmetry, each pivotally connected at opposite ends to said roof shield means and said sole plate means and extending from the latter forwardly and upwardly inclined towards said roof shield means, and two additional props likewise arranged mirror-symmetrically to said plane of symmetry and each pivotally connected at opposite ends to said roof shield means and said sole plate means and extending from the latter upwardly and rearwardly inclined towards said roof shield means.

* * * * *